US010974279B2

(12) United States Patent
Olsson

(10) Patent No.: US 10,974,279 B2
(45) Date of Patent: Apr. 13, 2021

(54) INFRASOUND GENERATOR FOR ENHANCING THE COMBUSTION OF SOLID FUELS

(71) Applicant: Mats Olsson, Lidingo (SE)

(72) Inventor: Mats Olsson, Lidingo (SE)

(73) Assignee: Infrasonik AB, Spånga (SE)

( * ) Notice: Subject to any disclaimer, the term of this patent is extended or adjusted under 35 U.S.C. 154(b) by 68 days.

(21) Appl. No.: 16/345,712

(22) PCT Filed: Oct. 24, 2017

(86) PCT No.: PCT/SE2017/000041
§ 371 (c)(1),
(2) Date: Apr. 28, 2019

(87) PCT Pub. No.: WO2018/080367
PCT Pub. Date: May 3, 2018

(65) Prior Publication Data

US 2019/0255569 A1 Aug. 22, 2019

(30) Foreign Application Priority Data

Oct. 31, 2016 (SE) ..... 1600303-0

(51) Int. Cl.

| | |
|---|---|
| ***B06B 1/10*** | (2006.01) |
| ***F23B 30/00*** | (2006.01) |
| ***F23C 99/00*** | (2006.01) |
| ***F23C 15/00*** | (2006.01) |
| ***B06B 1/12*** | (2006.01) |

(52) U.S. Cl.
CPC ..... *B06B 1/10* (2013.01); *B06B 1/12* (2013.01); *F23B 7/005* (2013.01); *F23C 15/00* (2013.01); *F23C 99/003* (2013.01); *B06B 2201/70* (2013.01); *F23B 2900/00005* (2013.01); *F23G 2202/703* (2013.01)

(58) Field of Classification Search
CPC ..... B06B 1/10; B06B 2201/70; F23B 7/005; F23B 2900/00005; F23C 99/003; F23C 15/00; F23G 2202/703
USPC ..... 431/2
See application file for complete search history.

(56) References Cited

U.S. PATENT DOCUMENTS 4,491,077 A * 1/1985 Petty ..... F23B 1/18 110/165 R

FOREIGN PATENT DOCUMENTS

| | | | |
|---|---|---|---|
| DE | 1031461 | B | 6/1958 |
| EP | 0144918 | A2 | 6/1985 |
| EP | 0197934 | B1 | 10/1986 |
| GB | 214616 | A | 1/1925 |
| JP | 04260706 | A * | 9/1992 |
| SE | 456524 | B | 6/1985 |

(Continued)

OTHER PUBLICATIONS

ISA/SE; Patent—och registeringsverket; Stockholm; Nov. 1, 2018.

*Primary Examiner* — Avinash A Savani
(74) *Attorney, Agent, or Firm* — Patshegen IP LLC; Moshe Pinchas

(57) ABSTRACT

The invention refers to an infrasound generator for enhancing the combustion of solid fuels burning in a combustion chamber. The infrasound is generated by one or more set(-s) of each two vibrating plates, vibrating in the same direction with the same displacement amplitude but in antiphase. The infrasound generator does not cause vibrations and is not sensitive to ash and heat from the combustion.

4 Claims, 2 Drawing Sheets

(56) References Cited

FOREIGN PATENT DOCUMENTS

| | | | | | |
|---|---|---|---|---|---|
| WO | WO-8800230 | * | 1/1988 | ..... | G10K 9/13 |
| WO | 9000093 | A1 | 1/1990 | | |

* cited by examiner

INFRASOUND GENERATOR FOR ENHANCING THE COMBUSTION OF SOLID FUELS

The present invention relates to an infrasound generator for enhancing the combustion of solid fuels.

It is known from, among others, the patent SE 461 896 that infrasound can be used for enhancing combustion of solid fuels. FIG. 1 of said patent application shows that the infrasound generator may be attached to the down pipe below the support grate of the burning fuel.

There are, however, a couple of problems associated with that type of infrasound generators.

One problem is that the infrasound generates vibrations.

Another problem is that it is difficult to generate enough acoustic power.

A third problem is that it is a risk that soot and ash particles from the combustion process enters into the infrasound generator.

A fourth problem is that heat from the combustion process may be transferred from the combustion process to the infrasound generator, resulting in too high temperature of the infrasound generator.

The object of the present invention is to provide an infrasound generator that overcomes the problems mentioned above.

The infrasound generator of the present invention is characterized in that it comprises one or more set(-s) of identical, parallel vibrating plates moving in the same direction but in antiphase. These vibrating plates generate an infrasound, but they do not cause vibrations as they move in the same direction, with the same displacement amplitude but in antiphase.

Each vibrating plate is mounted at a sound chamber. The two sound chambers of one set are mounted opposite each other at the down pipe below the combustion chamber.

The combustion is enhanced by a direct infrasound, which means that the travelling distance of the infrasound from the vibration plates to the burning solid fuel is much less than the wavelength of the infrasound, preferably less than one eighth of the wavelength of the infrasound.

The present description is now to be explained more closely by means of embodiments, which are disclosed as examples, and with reference to attached drawings.

FIG. 1 shows a combustion chamber (1) containing solid fuel (2) supported by a grate (3).

Figure 1:
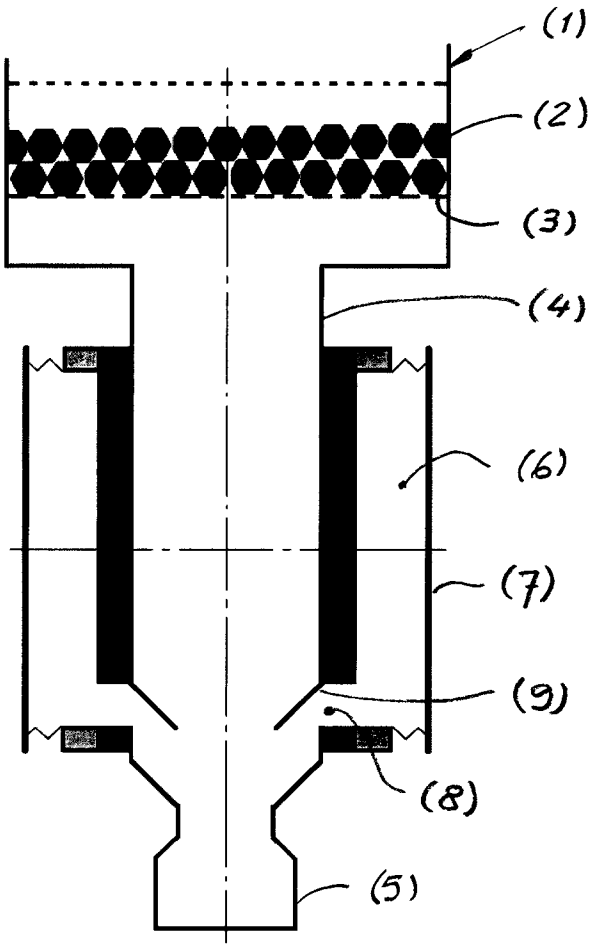
FIG. 1 is a cross sectional sketch of the infrasound generator and the combustion chamber.
Figure 2:
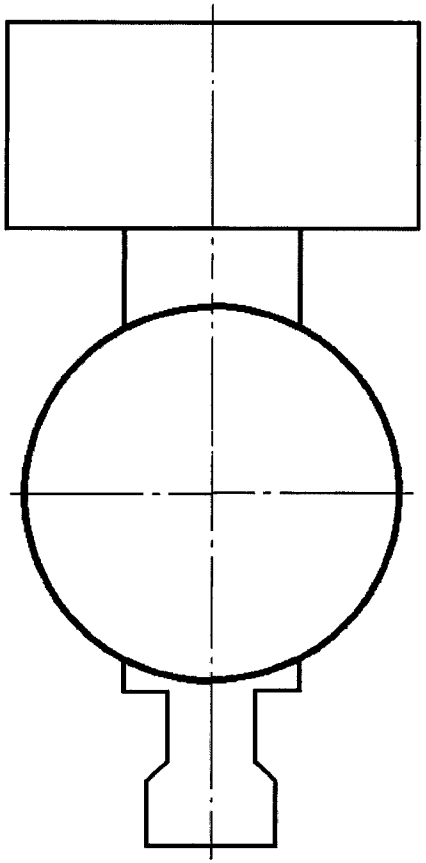
FIG. 2 is a side view of FIG. 1.

A vertical down pipe (4) connects the combustion chamber (1) to the ash pot (5).

The figure also shows a set of two sound chambers (6) situated opposite each other at each side of the down pipe (4). Vibrating plates (7) are mounted at each of the sound chambers (6).

There are connections (8) for the flow of infrasound between the sound chambers (6) and the down pipe (4).

There are flaps (9) preventing ash from the combustion to enter the sound chambers (6) via the openings (8).

The benefits of this invention are:

- The set(-s) of two plates (7) vibrating in the same direction with the same displacement amplitude but in antiphase does not cause vibrations.
- It is possible to generate a high acoustic power due to the fact that the design includes two or more vibration plates (7).
- The flaps (9) prevents ash particles from the combustion to enter into the sound cambers (6).
- The connections (8) have no pockets that could be filled by ach particles.
- There is a long distance from the burning solid fuel (2) to the vibrating plates (7) via the connections (8).

The invention claimed is:

1. An infrasound generator for enhancing the combustion of solid fuels (2) burning in a combustion chamber (1), equipped with a vertical down pipe (4) characterized in that said infrasound generator comprises one or more set(-s) of each two vibrating plates (7), each of said vibrating plate (7) of said set, situated parallel to each other, vibrating in the same direction with the same displacement amplitude but in antiphase and that each vibrating plate (7) is connected to a sound chamber (6)

and that said down pipe (4) is situated between said sound chambers (6)

and that there are connections (8) for the flow of infrasound between said sound chambers (6) and said down pipe (4)

and that there are flaps (9) in front of the connections (8) preventing ash particles from the combustion to enter into the sound chambers (6).

2. An infrasound generator according to claim 1 characterized in that the connections (8) between said sound cambers (6) and said down pipe (4) have no pockets where ash particles can fill up.

3. An infrasound generator according to claim 1, characterized in that the frequency of the sound generated by said infrasound generator is between 7 to 19 Hz.

4. An infrasound generator according to claim 3 characterized in that the frequency of the sound generated by said infrasound generator is between 11 to 16 Hz.

* * * * *